United States Patent [19]

Pollich

[11] 4,203,361

[45] May 20, 1980

[54] SHEET-FED ROTARY PRINTING MACHINE

[75] Inventor: Gerhard Pollich, Heidelberg, Fed. Rep. of Germany

[73] Assignee: Heidelberger Druckmaschinen Aktiengesellschaft, Heidelberg, Fed. Rep. of Germany

[21] Appl. No.: 911,451

[22] Filed: Jun. 1, 1978

[30] Foreign Application Priority Data

Jun. 2, 1977 [DE] Fed. Rep. of Germany ..... 2724856

[51] Int. Cl.[2] ..... B41F 7/10; B41F 21/00; B65H 5/12

[52] U.S. Cl. ..... 101/177; 101/183; 101/230; 101/231; 271/277

[58] Field of Search ..... 101/183, 184, 177, 229, 101/230, 231, 232, 407 A, 409; 34/10, 16, 148, 156; 271/DIG. 9, 184, 277, 225, 204, 194, 195, 226, 186

[56] References Cited

U.S. PATENT DOCUMENTS

| | | | |
|---|---|---|---|
| 2,933,039 | 4/1960 | Claybourn et al. | 101/183 |
| 3,742,847 | 7/1973 | Zimmerman et al. | 101/230 |
| 4,099,463 | 7/1978 | Zimmerman et al. | 101/230 |

FOREIGN PATENT DOCUMENTS

| | | | |
|---|---|---|---|
| 2137115 | 2/1973 | Fed. Rep. of Germany | 101/232 |
| 883712 | 7/1943 | France | 101/183 |

*Primary Examiner*—J. Reed Fisher
*Attorney, Agent, or Firm*—Herbert L. Lerner

[57] ABSTRACT

Sheet-fed rotary printing machine having a plurality of rotatable sheet transfer drums forming a sheet travel path between respective printing units of the machine having a respective rotary impression cylinder, includes a plurality of stationary sheet guide plates disposed below the sheet transfer drums and extending across substantially the entire width thereof, the impression cylinder being disposed in the sheet transfer path downstream of one of the sheet transfer drums and upstream of another of the sheet transfer drums, a first sheet guide plate extending toward the periphery of the one sheet transfer drum in direction of rotation thereof, a second sheet guide plate extending away from the periphery of the other sheet transfer drum in direction of rotation of the other sheet transfer drum so as to form, during rotation of the respective sheet transfer drum at any speed, an air cushion between the respective sheet guide plate and the underside of a sheet being transferred on the respective sheet transfer drum thereabove.

2 Claims, 1 Drawing Figure

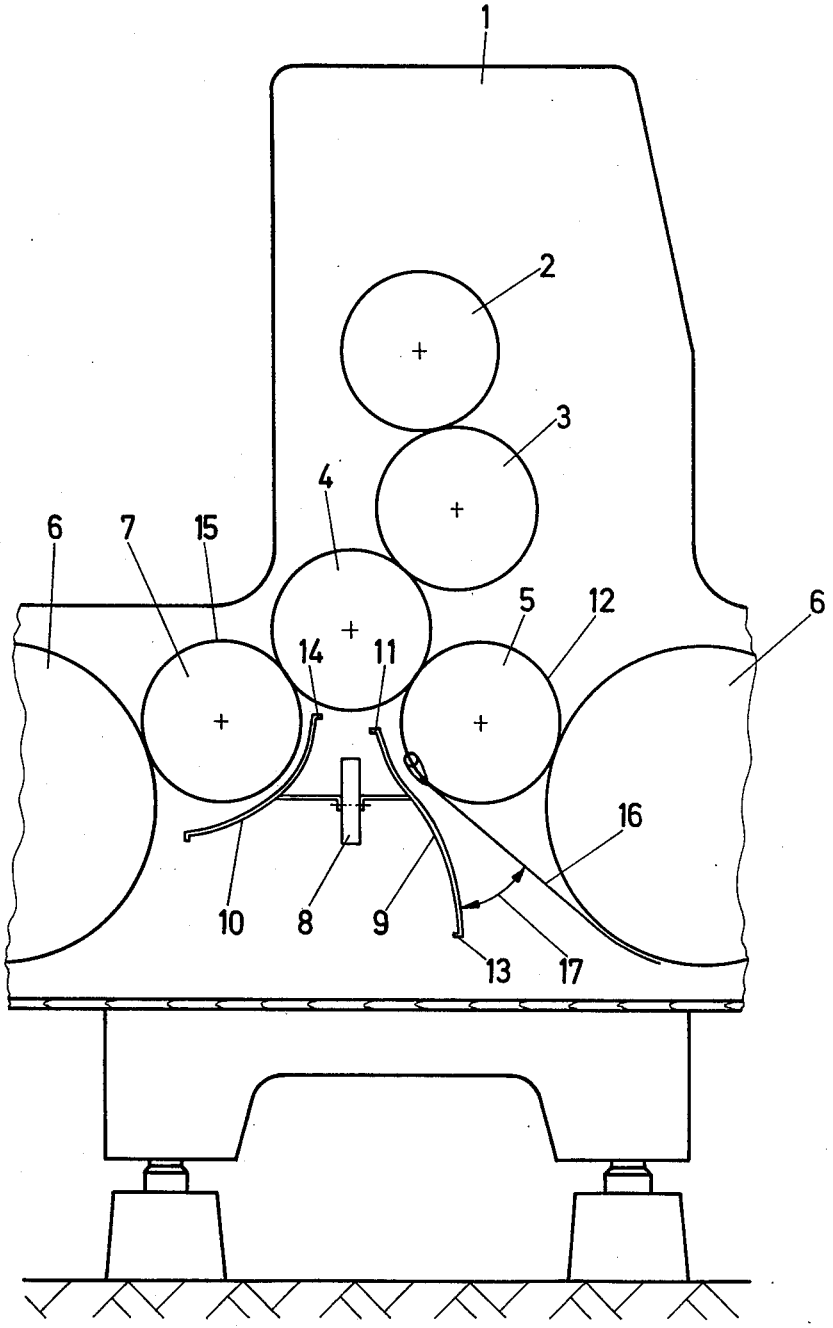
1
2
3
4
5
6
6
7
8
9
10
11
12
13
14
15
16
17

SHEET-FED ROTARY PRINTING MACHINE

The invention relates to a sheet-fed rotary printing machine, particularly for selectively printing on a single side of a sheet and on both sides of a sheet (perfecting) and which has sheet transfer drums disposed between the printing units of the machine, sheet guide plates extending over the entire width of the transfer drums being further provided under the transfer drums.

It has been generally known heretofore to provide guide bows under sheet transfer drums in rotary sheet-fed printing machines. This measure has a disadvantage, however, in that when the size of a sheet to be printed is changed, it is frequently necessary to adjust the guide bows, because otherwise creases would be formed in the printed sheet.

From East German Patent DL-PS 57 345, a device for transferring and turning a sheet is also known, wherein sheet guide bows are disposed between the impression cylinder and the sheet transfer drum, under the sheet transfer point.

Since the travel path of the sheet during perfector printing differs from that for single-side printing, when the machine is changed over from single-side printing to perfecting, or vice versa, the sheet guide bows must be changed to correspond to the required sheet travel path.

Furthermore, from West German Patent DE-PS 21 28 216, a device for sheet transfer and sheet turning in printing machines for selective single-side printing or perfecting has become known wherein a sheet transfer drum and the impression cylinder together constitute a sheet turning station. Both under the impression cylinder and under the sheet transfer drum, a stationary sheet guide plate is disposed, respectively, a short distance from the periphery of the respective cylinder and drum. The respective sheet guide plates are joined together by a third or central, adjustable sheet guide plate which is adjustable to positions for single-side printing and for perfecting.

In the perfecting position, all three sheet guide plates of the West German patent form a closed guide which, starting a short distance from and tangentially to the periphery of the impression cylinder, extends to or terminates in a path equidistant to and extending near the periphery of the sheet transfer drum. For single-side printing, the central sheet plate is swung as a couple of a sliding bow or loop into the gap or nip between the impression cylinder and the sheet transfer drum, so that it extends at a short distance from and tangentially to the periphery of the sheet transfer drum.

A disadvantage of the aforedescribed heretofore known device is that in the perfecting position, because of the tangential guidance of the sheet guide path, when the movement of the sheet guided by the impression cylinder is reversed, that is to say when the sheet has been gripped at the trailing edge thereof, the sheet will readily tend to rest on or come into contact with the sheet guide plate, at least at the trailing end thereof, so that the printed underside of the sheet is smudged. This is caused by the low speed thereof at that moment and because of the movement thereof parallel to the sheet guide path. Moreover, the single-side printing position of the central sheet guide plate encounters problems as well. Tests have, in fact, shown that the end of the sheet tends to adhere to the periphery of the impression cylinder or, in the case of especially smooth papers, to overtake the cylinder so that the sheet slips away over the top edge of the adjusted central sheet guide plate. If the second turning station is then located between the second and third printing units, for example, in a five-color machine having two turning stations, the underside of the sheet will be printed during a four-color single-side printing and one-color perfector printing. Despite the single-side printing position of the sheet guide plate this printed underside of the sheet will be smudged, because it is pulled away over the edge of the adjusted sheet guide plate.

It is therefore an object of the invention to provide a sheet-fed rotary printing machine which avoids the hereinaforementioned disadvantages of heretofore known devices of this general type and in which sheet guide plates are disposed under sheet transfer drums so that they will be stationary and in such a manner that both for single-side printing and for perfector printing the sheet is carefully and protectively guided and smudging of the printed underside of the sheet will not occur.

With the foregoing and other objects in view there is provided, in accordance with the invention, a sheet-fed rotary printing machine having a plurality of rotatable sheet transfer drums forming a sheet travel path between respective printing units of the machine having a respective rotary impression cylinder, comprising a plurality of stationary sheet guide plates disposed below the sheet transfer drums and extending across substantially the entire width thereof, the impression cylinder being disposed in the sheet transfer path downstream of one of the sheet transfer drums and upstream of another of the sheet transfer drums, a first sheet guide plate extending toward the periphery of the one sheet transfer drum in direction of rotation thereof, a second sheet guide plate extending away from the periphery of the other sheet transfer drum in direction of rotation of the other sheet transfer drum so as to form, during rotation of the respective sheet transfer drum at any speed, an air cushion between the respective sheet guide plate and the underside of a sheet being transferred on the respective sheet transfer drum thereabove.

In accordance with another feature of the invention, the one sheet transfer drum is a sheet turning drum disposed directly upstream of the impression cylinder in the sheet transfer path and including a third drum of the plurality of sheet transfer drums disposed immediately upstream of the one sheet transfer drum in the sheet transfer path, the first sheet guide plate approaching toward the periphery of the one sheet transfer drum in rotary direction of the one sheet transfer drum and extending substantially equidistantly from the periphery of the one sheet transfer drum in vicinity of the impression cylinder, the first sheet guide plate having a substantially sinusoidal shape over the length thereof and having an end portion facing toward the third sheet transfer drum and extending downwardly and radially to the one sheet transfer drum.

In accordance with a further feature of the invention, the second sheet guide plate has an end thereof disposed in immediate proximity of the periphery of the impression cylinder and extends from the end spirally away from the periphery of the other sheet transfer drum in rotary direction of the other sheet transfer drum.

Adjustment of the sheet fluid system in the event of change of format or of a change-over from single-side printing to perfecting is unnecessary. The air cushion, which is reliably formed through a wedge action, prevents the printed lower side of the sheet from encountering the sheet guide plates in either mode of printing, whether single-side printing or perfecting, and also for any output of the rotary sheet-fed printing machine. Smudging of perfector-printed sheets printed during transport of the sheets from one printing unit to another no longer occurs with the invention of the instant application.

Other features which are considered as characteristic for the invention are set forth in the appended claims.

Although the invention is illustrated and described herein as embodied in sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing which is a diagrammatic fragmentary side-elevational view of a sheet-fed rotary printing machine constructed in accordance with the invention.

The sole FIGURE of the drawing shows a printing unit 1 disposed in the central region of a multicolor printing machine which is convertible between single-side printing and perfector printing. As in the conventional construction, the printing unit 1 includes a plate cylinder 2, a blanket cylinder 3 and an impression cylinder 4. Upstream or forward of the impression cylinder 4, in travel direction of a sheet 16, a first small sheet transfer drum 5, which is in the form of a turning drum and, to the right-hand side of the drum 5 in the drawing, a sheet transfer drum 6 having a diameter, which is twice the length of the diameter of the sheet transfer drum 5, are disposed. The impression cylinder 4 is followed directly by a second small sheet transfer drum 7, the diameter of which corresponds to that of the impression cylinder 4. The sheet transfer drum 7 is then in turn followed on the left-hand side in the drawing by a second large sheet transfer drum 6 having a diameter which is twice the length of the diameter of the sheet transfer drum 7. Between the printing units 1, only one of which is fully shown in the drawing, there are thus disposed three sheet transfer drums 5, 6 and 7, the sheet transfer drum 5 being in the form of a turning drum when a turning station is involved, as is the case in the instant embodiment shown in the drawing. The sheet transfer drum 5 will therefore be referred to hereinafter only as a turning drum.

Two sheet guide plates 9 and 10 are fastened on a cross-member or transverse traverse 8 which is fixed to the machine housing and which extends below the impression cylinder 4. Both sheet guide plates 9 and 10 extend over or across the entire width of the sheet transfer drums 5, 6 and 7. The sheet guide plate 9 is disposed below the turning drum 5, and the sheet guide plate 10 below the sheet transfer drum 7.

The sheet guide plate 9 has an upper end 11 located in the immediate proximity of the impression cylinder 4 and extends for a short distance therefrom parallel to the contour of the periphery 12 of the turning drum 5, that is to say equidistantly spaced a slight distance therefrom. The sheet guide plate 9 than extends away from the drum periphery 12 to a lower end 13 thereof, which, in turn, extends downwardly, substantially radially to the turning drum 5 and almost as far as does the lower peripheral surface of the double-diameter sheet transfer drum 6. The sheet guide plate 9 thus has a slightly sinusoidally curved shape.

The other sheet guide plate 10 has an upper end 14 which is similarly disposed in the immediate proximity of the impression cylinder 4. At this location, the sheet guide plate 10 is closest to the periphery of the sheet transfer drum 7 and extends spirally away from the periphery of the sheet transfer drum 7 in the direction of rotation of the sheet transfer drum 7.

The modes of operation of the two sheet guide plates 9 and 10 are different. When, in the single-side printing position, the turning device, which includes the turning drum 5 and the sheet transfer drum 6, slides the end of the sheet 16 guided by the turning drum 5 out of the gap or nip between the turning drum 5 and the sheet transfer drum 6, it forms an air wedge with the surface of the sheet guide plate 9 during the downward fall thereof. The instant the end of the sheet is drawn into the region in which the upper end 11 of the sheet guide plate 9 extends virtually equidistantly to, and follows the contour of, the periphery 12 of the turning drums 5, this air wedge is compressed to form a reliably supporting air cushion. The underside of the sheet 16, which might possibly have been printed on, does not come into contact with the guide surface of the sheet guide plate 9.

The operation of the machine is similar to that described hereinabove when this turning station is in the perfector printing position. When the turning drum 5 is carrying the sheet 16 gripped at the trailing edge thereof, the leading edge of the sheet 16 is withdrawn substantially tangentially from the sheet tramsfer drum 6. The sheet 16, together with the end 13 of the sheet guide plate 9, which extends substantially vertically downwards, then necessarily forms a rather considerable air wedge 17. This air wedge 17 produces such a strong air cushion that, even with a low printing output, the printed underside of the sheet 16 cannot be smudged by the guide surface of the sheet guide plate 9.

The operation of the machine is different with regard to the sheet guide plate 10. The sheet transfer drum 7 takes over the sheet 16 from the impression cylinder 4 and transfers it to the double-diameter sheet transfer drum 6. Because of the printing pressure, the trailing end of the sheet 16 is pressed so firmly against the peripheral surface of the impression cylinder 4 that the sheet 16 must be pulled away from the impression cylinder 4 and therefore clings closely to the periphery 15 of the sheet transfer drum 7. Only when the trailing end of the sheet 16 has been withdrawn from the impression cylinder 4 does the sheet 16 drop. The unprinted trailing edge of the sheet is then deposited on the sheet guide plate 10, pushing in front of it an air cushion which prevents the printed surface of the underside of the sheet 16 from coming into contact with the guide surface of the sheet guide plate 10. Thus, again, smudging of the printed underside of the sheet 16 is effectively prevented thereby.

There are claimed:

1. Sheet-fed rotary printing machine having a plurality of rotatable sheet transfer drums forming a sheet travel path between respective printing units of the machine having a respective rotary impression cylinder, comprising a plurality of stationary sheet guide plates disposed below the sheet transfer drums and extending across substantially the entire width thereof, the impression cylinder being disposed in the sheet transfer path downstream of one of the sheet transfer drums and upstream of another of the sheet transfer drums, the one sheet transfer drum being a sheet turning drum disposed directly upstream of the impression cylinder in the sheet transfer path, said stationary sheet guide plates including a first sheet guide plate extending toward the periphery of the one sheet transfer drum in direction of rotation thereof, and a second sheet guide plate extending away from the periphery of the another sheet transfer drum in direction of rotation of the another sheet transfer drum, the plurality of sheet transfer drums including a third drum disposed immediately upstream of the one sheet transfer drum in the sheet transfer path, said first sheet guide plate approaching toward the periphery of the one sheet transfer drum in rotary direction of the one sheet transfer drum and extending substantially equidistantly from the periphery of the one sheet transfer drum in vicinity of the impression cylinder, said first sheet guide plate having a substantially sinusoidal shape over the length thereof and having an end portion facing toward the third sheet transfer drum and extending downwardly and substantially radially to the one sheet transfer drum so as to form, during rotation of the respective sheet transfer drum at any speed, an air cushion between the respective sheet guide plate and the underside of a sheet being transferred on the respective sheet transfer drum thereabove.

2. Sheet-fed rotary printing machine according to claim 1 wherein said second sheet guide plate has an end thereof disposed in immediate proximity of the periphery of the impression cylinder and extends from said end spirally away from the periphery of said another sheet transfer drum in rotary direction of said another sheet transfer drum.

* * * * *